219-121 SR
11/26/85 OR 4,555,609

United States Patent [19]
Marhic et al.

[11] Patent Number: 4,555,609
[45] Date of Patent: Nov. 26, 1985

[54] ARC WORKING TORCHES

[75] Inventors: Gërard Marhic, Cergy; Didier Schaff, Auvers-sur-Oise; Francis Remy, Montigny-les-Cormeilles, all of France

[73] Assignee: L'Air Liquide, Societe Anonyme pour l'Etude et l'Exploitation des Procedes Georges Claude, Paris, France

[21] Appl. No.: 535,881

[22] Filed: Sep. 26, 1983

[30] Foreign Application Priority Data

Oct. 1, 1982 [FR] France ..... 82 16511

[51] Int. Cl.[4] ..... B23K 9/00
[52] U.S. Cl. ..... 219/121 PC; 219/121 PM; 219/137.63; 219/137.31
[58] Field of Search ..... 219/137.63, 137.31, 219/136, 74, 75, 76.16, 121 P, 121 PM, 121 PP, 121 PQ, 121 PC; 361/115; 200/321, 322

[56] References Cited

U.S. PATENT DOCUMENTS

| | | | |
|---|---|---|---|
| 3,217,133 | 11/1965 | Mattmuller et al. | 219/75 |
| 3,488,468 | 1/1970 | Carbone | 219/136 |
| 3,562,486 | 2/1971 | Hatch et al. | 219/121 |
| 3,632,951 | 1/1972 | Klasson | 219/75 |
| 3,847,287 | 11/1974 | Dinse | 219/137.63 |
| 4,210,796 | 7/1980 | Moerke | 219/137.63 |

FOREIGN PATENT DOCUMENTS 2450659 3/1980 France .

*Primary Examiner*—M. H. Paschall
*Attorney, Agent, or Firm*—Lee C. Robinson, Jr.

[57] ABSTRACT

This invention relates to arc working torches.

To prevent the operator from touching the live electrode, the free end of the torch is provided with a cowling formed by a protective skirt on the one hand and on the other hand by a tilting stirrup hinged on this skirt which engages on the torch body while closing an electrical circuit forming part of the safety circuit of the torch. The invention is applied to manual plasma cutting torches.

8 Claims, 3 Drawing Figures

ARC WORKING TORCHES

BACKGROUND OF THE INVENTION

The present invention relates to arc working torches of the kind comprising a removable cowling intended to surround the free extremity of the head of the torch. It is applicable more particularly although not exclusively to the manual plasma cutting torches in which the removable cowling helps protect the operator.

During utilisation of the torch, the electrode of a manual plasma cutting torch is raised to a comparatively high potential with respect to earth, of the order of 300 V. This electrode is normally rendered inaccessible by the presence of the nozzle of the torch, but the electrode is uncovered if disassembling of this nozzle is required for servicing the device, which is dangerous to the operator in case of accidental actuation of the control trigger of the torch.

For this reason, it has been proposed that the free end of the torch be provided with a removable protective cowling or hood whose presence prevents the disassembling of the nozzle. The fastening of this cowling on the torch body closes an electrical circuit which forms part of the torch safety circuit, which also comprises other circuits (for example corresponding to a correct supply of fluid). Nevertheless, the known systems did not yield complete satisfaction because they are comparatively difficult to produce and exhibit excessive cost.

It is an object of the invention to provide a removable cowling or hood, which is uncomplicated, may be handled reliabley and rapidly and is inexpensive.

SUMMARY OF THE INVENTION to achieve this and other objects, the invention consists in an arc working torch of the aforesaid kind, wherein the cowling comprise a skirt arranged to be positioned axially by a shoulder of the torch head, and a tilting stirrup hinged on a first of the two elements formed by the skirt and by the head and provided with clipping means for clipping onto the other of these two elements.

This cowling may serve the purpose of protecting the operator as referred to in the foregoing. In this case, it is advantageous for the stirrup to comprise a metal portion provided with said clipping means and which, when the cowling is secured on the head of the torch, co-operates with two terminals on the said other element and forms part of an electrical circuit appertaining to the safety circuit of the torch.

In an advantageous embodiment of the invention, the skirt bears on the said shoulder via an element of the torch which it keeps thrust against this shoulder. As a matter of fact, the said element may then be devoid of any screw-thread and may simply be centered in the said shoulder. Furthermore, in this embodiment, it becomes very unlikely if not impossible to re-install the cowling on the torch body in the absence of the said element. This is of special interest if this element is formed by the nozzle of a plasma torch, since the electrode tip is then inaccessible except in the absence of the cowling.

Also, and preferably, the skirt may have a projection opposed to the skirt which prevents dismantling of the electrode holder clip when the cowling is in position. This eliminates any possibility of gaining access to the electrode at its installed end when this electrode is energised.

BRIEF DESCRIPTION OF THE DRAWINGS

One embodiment of the invention will now be described with reference to the accompanying drawings by way of example, in which.

DETAILED DESCRIPTION OF THE PREFERRED EMBODIMENT

Figure 1:
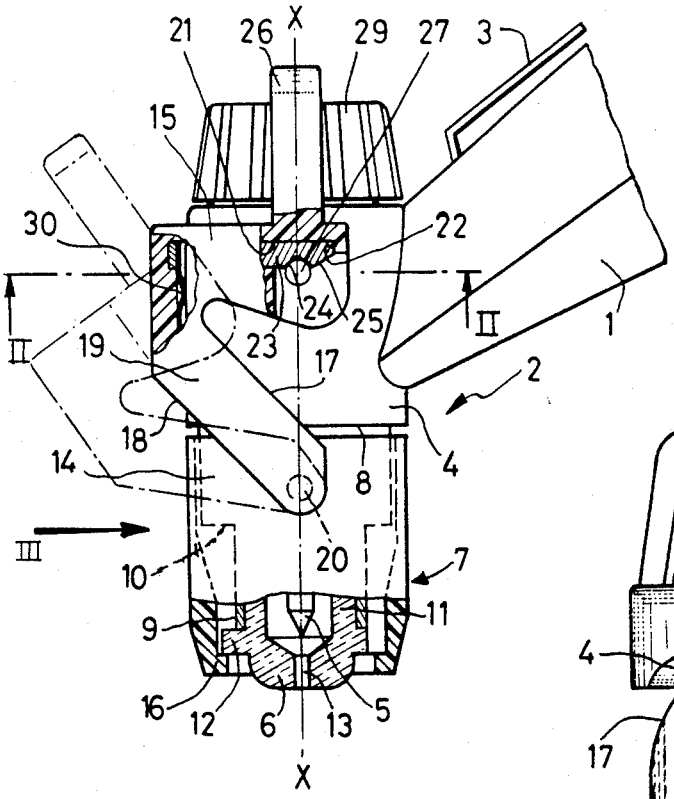
FIG. 1 is a view in lateral elevation, with partial cross-sectioning and cut away sections, of a manual plasma cutting torch in accordance with the invention.
Figure 3:
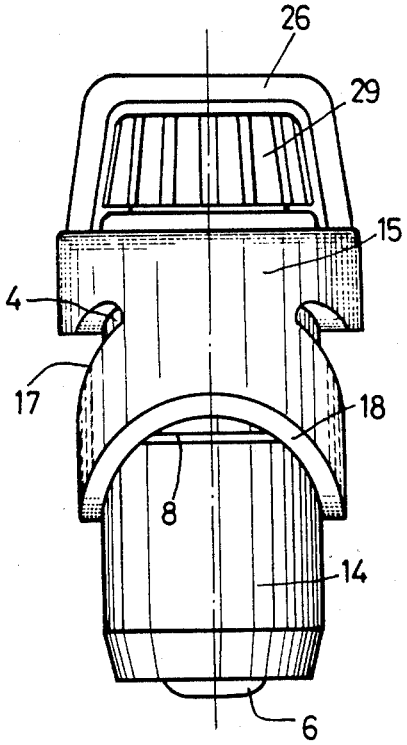
FIG. 3 is a front view of the torch, taken as seen along the arrow III of FIG. 1.

The manual plasma cutting torch illustrated in the drawings comprises an insulating handle 1 which at its ends carries a cutting head 2 and is provided at its upper part with a trigger 3 for fluid infeed control and for energisation. Altogether, the head 2 is a body of revolution around an axis X—X which will be assumed to be vertical to simplify the description. The head 2 substantially comprises an insulating member 4, and electrode 5, a nozzle 6 and a protective cowling 7.

The member 4 has a cylindrical shape and terminates just below the handle 1 in a horizontal extreme surface 8. On this member 4 project in downward direction the electrode 5 on the one hand, which extends along the axis X—X and is positioned by an electrode carrier means (not illustrated), and on the other hand a nozzle means appropriately insulated electrically from the electrode carrier means and which terminates in a tubular element 9. At approximately half-height, the nozzle carrier means forms a step 10 so that its lower portion has a smaller diameter.

The nozzle 6 is a generally cup-shaped element. Its sidewall 11 is smooth and fits without play in the element 9 of the nozzle carrier means, until a flange 12 of the nozzle strikes the extreme section of this element 9. The flange 12 is situated at the lower end of the wall 11 and has a polygonal or stellate form. The bottom of the nozzle is transpierced by an orifice 13 having the axis X—X.

The protective cowling 7 is formed by a lower annular cylindrical skirt 14 and by a tilting stirrup or plate 15 hinged on this skirt. These two elements are made of an appropriate insulating material making allowance for the temperatures to which they are exposed in operation. The skirt 14 engages with a small clearance on the upper part of the nozzle holder and is provided at its lower end with a radial flange 16 directed towards the axis X—X which bears on the outer corners of the flange 12 of the nozzle.

The plate 15 has a generally semicylindrical shape, widely notched at each side by an approximately triangular notch 17 truncated at its lower part by an oblique face 18. The notches 17 and the oblique face 18 leave in being an incurved fork 19 which enflanks half the head 2 opposite to the handle 1. The extremity of each branch of this fork is hinged on the skirt 14 by means of a radial stud 20, the two studs being diametrically opposed.

Close to its upper extremity, the plate 15 comprises a horizontal groove 21 which extends over a little more than half a turn and which defines a seat delimited at each side by a vertical shoulder 22. In this seat is received a metal blade 23 which, at each extremity and at two diametrically opposed points, has a downwardly open V-shaped notch 24 extended towards the extremity of the blade by a rising ramp 25. Abreast of the notches 24, the plate 15 carries an upwardly projecting hoop 26.

Figure 2:
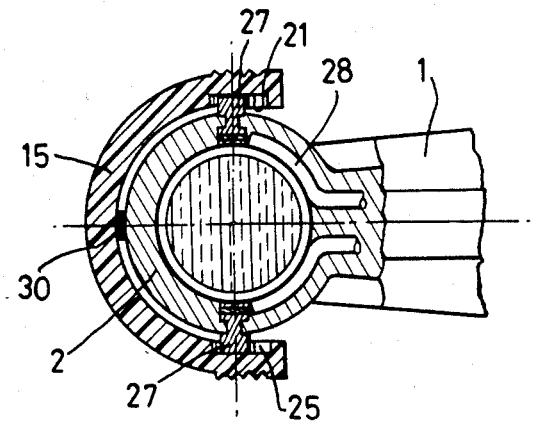
FIG. 2 is a view of this torch taken in cross-section along the line II—II of FIG. 1.

From the insulating member 4 project two horizontal cylindrical studs 27, which are diametrically opposed, each being connected to a wire 28 (FIG. 2) of an electrical circuit which forms part of the safety circuit of the torch.

The torch is completed by piping (not illustrated) rendering it possible to supply the same with the various fluids needed for its operation, as well as by means (not illustrated) for supplying electric current.

To position the electrode 5 in the torch head 2, a clip (not illustrated) is actuated, forming part of the electrode carrier means, by means of a removable gripping knob 29 which is screwed to the upper end of the head 2.

To install the nozzle 6 in the head 2, it is inserted into the element 9 of the nozzle carrier means and the skirt 14 is engaged over the same. During this operation, the plate 15 is tilted through approximately 45°, as illustrated dash-dotted in FIG. 1, which is rendered possible by the presence of the oblique face 18.

When the flange 12 of the nozzle, impelled by the flange 16 of the skirt 14, strikes the shoulder formed by the extreme section of the element 9, the upper extremity of the skirt is situated at a small distance from the surface 8, without touching the same. The plate 15 is then returned to the vertical position; at the end of this displacement, the ramps 25 of the blade 23 impinge on the studs 27 and then rise over these, and the studs 27 clip simultaneously into the notches 24 of the blade. This is rendered possible by the axial elasticity imparted to the plate 15 by the two lateral notches 17. The dimensioning is such that after engagement, the plate does not return completely to its initial shape, so that it holds the skirt 14 elastically in upward direction and consequently assures a firm retention in position of the nozzle 6.

When the cowling 7 is in position, the hoop 26 straddles the knob 29 with a small clearance, and the electrical circuit comprising the two studs 27 is closed by the blade 23 which allows of operation of the torch under control by the trigger 3 when the other sections of the safety circuit are also closed, By contrast, it is impossible to gain access to the electrode 5: on the one hand, gaining access to the electrode tip presupposes withdrawal of the nozzle 6, which requires initial disassembly of the skirt 14; on the other hand, the presence of the hoop 26 prevents unscrewing the knob 29 and consequently access to the upper extremity of the electrode.

Access to the electrode is consequently possible only if the plate 15 had first been tipped to its withdrawn position shown dash-dotted in FIG. 1. Since this tipping action opens the safety circuit, the electrode is consequently inaccessible unless it is de-energized.

Furthermore, engagement of the blade 23 on the studs 27 is possible only if the skirt 14 actually bears on the flange 12 of the nozzle. To prevent this blade being hooked on to these studs in the absence of the nozzle, the blade has a downwardly directed extension 30 at its middle, which slopes towards the element 4 when at rest. This extension is repelled elastically by the element 4 when the plate 15 is brought to the vertical position and tends to return this latter to its withdrawn position. The plate may thus remain in the vertical position only if the engaging force on the studs 27 is sufficient.

As stated in the foregoing, the skirt 14 bears on the flange 12 at a definite number of points only, which are separated by openings. The skirt may thus also serve the purpose of channelling an annular gas flow around the nozzle; this gas may be a cooling gas or, in the case of a plasma welding torch, a gas for protection of the molten bath.

As a modification, the flanges 12 and 16 could evidently have other outlines allowing of a flow of this nature around the nozzle.

Also as a modification, the nozzle 6 could be screwed int the tubular element 9; the skirt 14 would then bear directly on the shoulder 8 of the torch body 4 and would be clear of any contact with the nozzle. Nevertheless, the embodiment illustrated in the drawings offers the advantage of not requiring any screw-threading of the nozzle or of the element 9. More generally, the cowling 7 could, with other torch layouts, serve the purpose of holding an element of the torch head 2 thrust against a shoulder, with the same advantage, possibly associated with the function of gas channelling of the skirt 14.

Again as a modification, although this actually appears to be less advantageous, the stirrup or plate 15 could be inverted and hinged on the studs 27 of the head 2 and clip onto two other similar studs provided on the skirt 14. The adaptation of the electrically conductive parts of the cowling 7 to this modified form will appear evident to those skilled in the art.

We claim:

1. An arc working torch comprising, in combination: an electrode;

a head element surrounding the electrode and having a shoulder and a free end;

a removable protective cowling having a skirt elemnent surrounding the free end of the head element and axially positioned by said shoulder;

a tilting stirrup pivotally supported by one of said elements for movement between an open position and a closed position;

clipping means for releasably connecting the stirrup to the other of said elements to thereby secure said cowling to said head element in the closed position of said stirrup;

actuating means for supplying electrical energy to said electrode; and a safety circuit connected to said actuating means for interrupting the supply of electrical energy, the safety circuit including a pair of terminals carried by said other element.

2. A torch according to claim 1, wherein said stirrup is formed from an insulating material and is provided with a semicircular metal insert having two peripheral ends and, at each end, a clipping notch directed towards said one element, the notches cooperating with said terminals for connecting said stirrup to said other element, said terminals being formed by two diametrically opposed studs projecting from said other element.

3. A torch according to claim 1, wherein said stirrup comprises a plate of generally semicylindrical shape pivotally connected to said first element at two diametrically opposed points and provided with lateral notches which impart to it an axial elasticity.

4. A torch according to claim 1, wherein said head element includes a member having a flange adjacent the free end of the head element, said skirt bearing against said flange to hold it in contact with said shoulder.

5. A torch according to claim 1, wherein said one element comprises an electrically conductive member which electrically connects said terminals in said closed position of said stirrup.

6. A torch according to claim 5, in which the electrode is removably disposed within the head element, and the stirrup has a projecting portion for preventing the removal of the electrode means when the stirrup is in its closed position.

7. A torch according to claim 4, wherein said skirt bears on said flange whilst leaving uncovered passages for a cooling and/or protective gas.

8. An arc working torch comprising, in combination:

an electrode;

a head element of generally cylindrical configuration surrounding the electrode;

means including a removable skirt element surrounding a portion of the head element;

a stirrup supported by one of said elements for movement between a closed position in which the stirrup maintains the skirt element around said head element portion and an open position permitting the removal of said skirt element;

clipping means for releasably connecting the stirrup to the other of said elements to thereby hold said stirrup in said closed position;

a spring for biasing the stirrup to its open position;

actuating means for supplying electrical energy to said electrode; and a safety circuit connected to said actuating means for interrupting the supply of electrical energy, the safety circuit including a pair of terminals carried by said other element and an electrically conductive member forming a portion of said one element and electrically connecting said terminals in said closed position of said stirrup;

said biasing spring comprising a resilient extension of said electrically conductive member.

* * * * *